United States Patent [19]

Litchfield

[11] 4,042,288

[45] Aug. 16, 1977

[54] EXTRUDED PLASTIC PANEL DRAWERS

[75] Inventor: Leon G. Litchfield, Youlgreave, England

[73] Assignee: L. B. (Plastics) Limited, England

[21] Appl. No.: 578,382

[22] Filed: May 19, 1975

Related U.S. Application Data

[62] Division of Ser. No. 364,710, May 29, 1973, Pat. No. 3,901,572

[30] Foreign Application Priority Data

Dec. 8, 1972 United Kingdom ..... 56752/72

[51] Int. Cl.[2] ..... A47B 88/00

[52] U.S. Cl. ..... 312/330 R; 312/257 R; 312/320; 160/381

[58] Field of Search ..... 312/330, 214, 342, 320; 160/381; 248/27 R

[56] References Cited

U.S. PATENT DOCUMENTS

| | | | |
|---|---|---|---|
| 1,939,955 | 12/1933 | Cornelius | 160/381 |
| 2,335,391 | 11/1943 | Cushing | 312/320 |
| 2,762,677 | 9/1956 | Reeves | 312/330 |
| 3,282,635 | 11/1966 | Himelreich | 312/214 |
| 3,377,115 | 4/1968 | Hansen et al. | 312/330 |
| 3,468,448 | 9/1969 | McHollan et al. | 248/27 R |
| 3,490,823 | 1/1970 | Neu et al. | 312/330 X |
| 3,511,550 | 5/1970 | Hilfinger et al. | 312/330 |
| 3,556,626 | 1/1971 | Schock | 312/214 |
| 3,610,719 | 10/1971 | Alston | 312/330 |
| 3,687,512 | 8/1972 | Alston | 312/257 R |
| 3,767,281 | 10/1973 | Adams | 312/330 R |
| 3,815,800 | 6/1974 | Monahan | 312/330 R |

*Primary Examiner*—Paul R. Gilliam
*Assistant Examiner*—Victor N. Sakran
*Attorney, Agent, or Firm*—Marshall & Yeasting

[57] ABSTRACT

A drawer construction in which at least the sides and back are formed from identical hollow extruded plastics panels each provided with a longitudinal recess in the face thereof which will be innermost in use in order to accommodate a drawer bottom, and the panels being interconnected at right angles to one another by corner pieces engaged in the open ends of the panels. Detent means are preferably provided to retain the corner pieces securely in engagement with the open ends of the panels.

3 Claims, 5 Drawing Figures

EXTRUDED PLASTIC PANEL DRAWERS

The invention relates to drawer constructions, and is a division of Application Serial No. 364,710, filed May 29, 1973, now U.S. Pat. No. 3,901,572.

It is an object of the invention to provide means whereby a drawer may be relatively cheaply produced and readily assembled either by the manufacturer or purchaser without the need for special tools.

The invention provides a drawer construction in which at least the sides and back are formed from identical hollow extruded plastics panels each provided with a longitudinal recess in the face thereof which will be innermost in use in order to accommodate a drawer bottom, and the panels being interconnected at right angles to one another by corner pieces engaged in the open ends of the panels.

Preferably the faces of the panels opposite to those in which said longitudinal recesses are formed are each provided with a longitudinal groove or channel adapted to locate on runners forming part of a cabinet or the like in which the drawer is supported in use.

Preferably also, means is provided to retain the corner pieces securely in engagement with the open ends of the panels. For this purpose each panel may be provided with apertures in one face thereof adjacent its opposite ends, the portions of the corner pieces which locate in the open ends being provided with projecting detent members carried on flexible parts of the corner pieces so as to be depressed when the corner pieces are inserted and to spring out into engagement with the apertures when the corner pieces are pushed fully home. Alternatively those portions of the corner pieces which locate within the panels may be secured by adhesive or solvent welding.

Preferably also, the corner pieces are arranged such that the portions thereof which remain exposed following connection of the panels are of slightly different lengths when viewed in plan such that the panels overlap one another. This presents a neat appearance to the interior of the assembled drawer and eliminates unsightly gaps through which the interior of the corner pieces could be seen.

The side and back only of the drawer may be formed from identical extruded panels of the kind referred to, the drawer front constituting a separate panel. In this case the front panel is preferably connected to the drawer sides by connecting members secured to the front panel and adapted to engage within the hollow side panels. These connecting devices may be provided with retaining means or secured by adhesive or solvent welding as described in relation to the corner pieces mentioned above.

Alternatively all four sides of the drawer may be constructed from identical extruded plastic panels, being connected together by means of four corner pieces of the kind referred to above. In this instance a separate handle may be attached to the panel which constitutes the drawer front. Such handle may comprise an extruded strip member engaged with the longitudinal channel in the drawer front where the panels contain such channels.

Embodiments of the invention will now be described, by way of example only, with reference to the accompanying drawings, in which.

Figure 1:
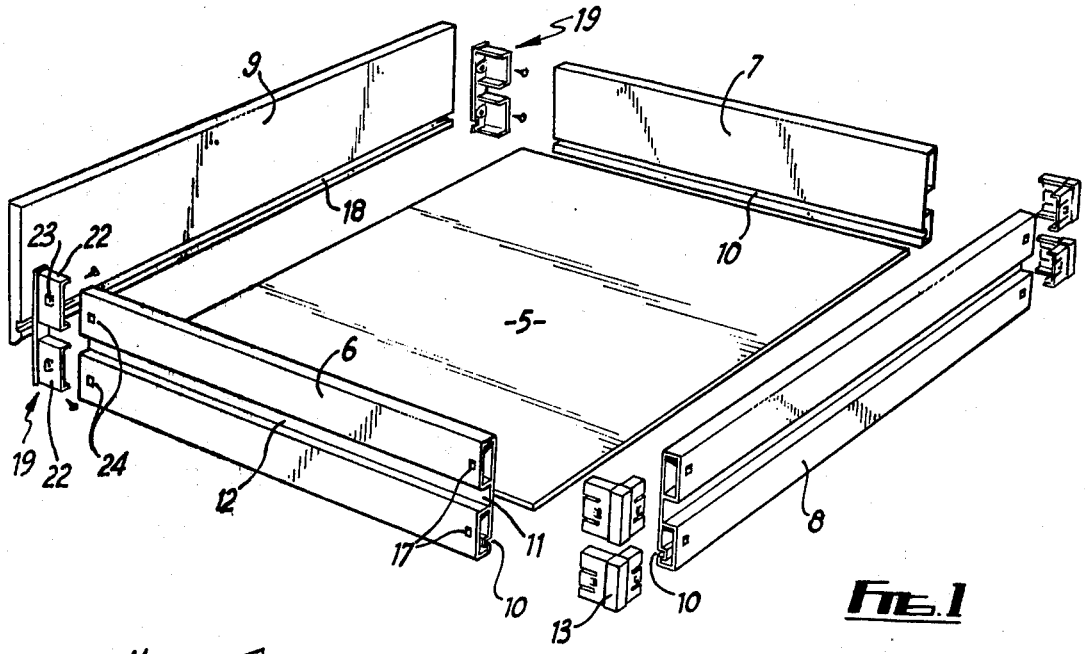
FIG. 1 is an exploded view of a drawer assembly according to the invention.

Referring to the drawings, the drawer assembly comprises a floor 5, opposed side walls 6 and 7, a back wall 8 and a front panel 9. The side walls 6 and 7 and the back wall 8 are constructed from identical extruded sections of synthetic plastics material. Each such wall or panel incorporates a longitudinal recess 10 near to the lower edge of the face of the panel which is innermost in use, these recesses 10 serving to receive the edges of the floor 5. The panels consist of upper and lower hollow portions of rectangular section interconnected by a longitudinal web 11 which defines an opening or channel 12. The channels 12 in the two side walls 6 and 7 are adapted, in use, to locate over runners in a cabinet or other article of furniture in which the drawer is mounted so as to permit sliding movement of the drawer between open and closed positions.

Figure 2:
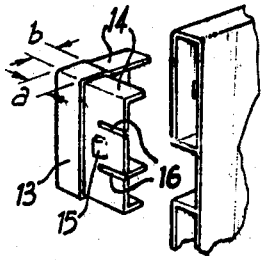
FIG. 2 is an enlarged perspective view showing a connecting piece used between identical drawer panels.

The side panels 6 and 7 and back panel 8 are interconnected by corner pieces one of which is shown in greater detail in FIG. 2. Each corner piece consists of a post 13 having locating members 14 projecting from two adjacent sides thereof at right angles and dimensioned so as to form a relatively tight fit in one of the upper or lower hollow portions of a side or back wall panel. Two such corner pieces are utilised at each corner and when engaged in the adjacent panels they connect these together ar right angles to one another. In order to prevent accidental separation of the parts, the corner pieces are provided with projecting detent members 15 mounted centrally of the locating members 14 which are slotted at 16 to increase the resilience of the central region. Each detent member 15 is chamfered in order that the corner piece may be readily pushed into the open end of the associated panel, the detent member 15 springing outwards into locking engagement with the associated opening 17 when the corner piece has been pushed fully home.

Figure 3:
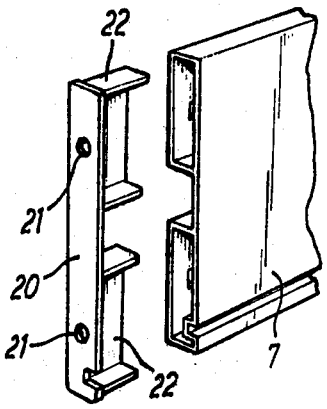
FIG. 3 is an enlarged perspective showing a connecting piece for attaching the drawer front to the assembly.

The post 13 of each corner piece is of rectangular rather than square section in plan view, the distance '*a*' (FIG. 3) slightly exceeding the distance '*b*'. As a result adjacent edges of the back and side panels overlap one another slightly, thereby forming a more satisfactory join and eliminating cracks or slots, through which the interior of the corner pieces might otherwise be visible from within the drawer. By suitable marking of the locating members 14 of the corner pieces correct assembly of the components may be ensured.

The front panel 9 is of different construction from the sides and back, comprising a generally flat panel not of hollow construction but provided with a longitudinal groove 18 for reception of the forward edge of the drawer floor. The front panel is connected to the remainder of the assembly by connecting pieces 19 shown in FIGS. 1 and 3. Each connecting piece consists of a strip-like base 20 provided with apertures 21 by means of which it may be attached to the rear face of the drawer front using screws or the like. Locating members 22 project from the member 20 at right angles thereto and are dimensioned for engagement in the upper and lower hollow portions of the side walls 6 and 7. Detent members 23 similar to those provided on the corner pieces are provided on the outer faces of each member 22 and these engage with apertures 24 in the respective side walls to secure the parts against accidental separation.

Figure 4:
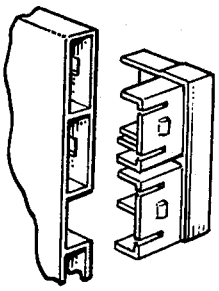
FIGS. 4 and 5 are views similar to FIGS. 2 and 3 showing modified connecting pieces.
Figure 5:
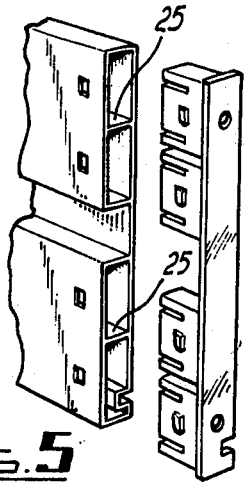

FIGS. 4 and 5 illustrate modified connecting pieces for use with panels of increased depth which have internal dividing walls 25 in each of the upper and lower hollow sections. The construction and function of the connecting pieces of FIGS. 4 and 5 is otherwise similar to those described with reference to FIGS. 2 and 3.

Thus in manufacture of the drawer, the sides and back may be cut to suitable lengths from a single extruded section, the holes 17 and 24 being punched subsequently adjacent the respective ends and the parts then being assembled around the floor 5 by means of the corner pieces. The front panel fitted with its connecting pieces may then be engaged with the leading ends of the side walls and the front edge of the floor to complete assembly of the drawer. Apart from the attachment means necessary to secure the connecting pieces 19 to the back wall of the front panel, no other separate connecting members are required in assembling the drawer. The facility for providing both sides and the back from a single extrusion also considerably simplifies production and reduces cost.

In a modification the front panel may consist of an extruded section identical to the sides and back, the front panel in this case being connected to the rest of the assembly using corner pieces identical to those used to connect the sides to the back. A separate handle may then be attached to the front face of the front panel and as this face will include a recess 12 the handle may consist of an extruded component clipped into the recess and projecting outwardly and downwardly from the upper edge of the recess to form a drawer pull.

In a further modification the detent members provided on the corner pieces and connecting pieces and the associated apertures in the drawer panels may be eliminated and the parts connected using adhesive or solvent welding. Attainment of an effective bond may be improved by providing fluting on the faces of the locating members previously occupied by the detents. By virtue of this arrangement drawers of various different sizes may be constructed from standard lengths of extruded wall-forming section, particularly where the front wall consists of the same extrusion.

Various other modifications may be made without departing from the invention. For example, alternative forms of corner piece or connecting piece could be utilised provided they engaged within the hollow side and end panels, and such panels may be of various cross-sectional configurations and have various arrangements of internal reinforcement if required.

I claim:

1. A drawer construction in which at least the sides and back are formed from extruded plastics panels of identical section, the section of each panel being uniform throughout its length, each panel comprising a vertical sheet, said vertical sheets forming the inner walls of the drawer, intersecting at the corners of the drawer, and having a groove to receive a drawer bottom, each vertical sheet having a pair of hollow sections of rectangular cross-section formed on its outer side and defining a channel therebetween, which are identical except for the groove in the inner face of the lower section, the back of which channel is defined by the portion of the outer surface of said sheet disposed between said box-like sections and the panels being interconnected at each corner by identical upper and lower corner pieces engaged in the open ends of the respective upper and lower box-like sections, means to retain the corner pieces securely in engagement with said open ends, and a front panel connected to the drawer sides by connecting members secured to the front panel and adapted to engage within the side panels.

2. A drawer construction according to claim 1 wherein each panel is provided with apertures in one face thereof adjacent its opposite ends, the portions of the corner pieces which locate in the open ends being provided with projecting detent members carried on flexible parts of the corner pieces so as to be depressed when the corner pieces are inserted and to spring out into engagement with the apertures when the corner pieces are pushed fully home.

3. A drawer construction according to claim 1 wherein the sides and back only of the drawer are formed from extruded panels of identical section.

* * * * *